US009695567B2

(12) United States Patent
Li et al.

(10) Patent No.: US 9,695,567 B2
(45) Date of Patent: Jul. 4, 2017

(54) SYSTEM AND METHOD FOR MONITORING AND CONTROLLING GROUTING OPERATIONS

(71) Applicant: Mayland Metallic Materials Ltd., Richmond Hill (CA)

(72) Inventors: Xiaofeng Li, Richmond Hill (CA); Shuihan Li, Richmond Hill (CA)

(73) Assignee: Mayland Metallic Materials Ltd., Richmond Hill (CA)

( * ) Notice: Subject to any disclaimer, the term of this patent is extended or adjusted under 35 U.S.C. 154(b) by 0 days.

(21) Appl. No.: 14/621,461

(22) Filed: Feb. 13, 2015

(65) Prior Publication Data

US 2016/0237636 A1 Aug. 18, 2016

(51) Int. Cl.
*E02D 3/12* (2006.01)

(52) U.S. Cl.
CPC ..... *E02D 3/12* (2013.01)

(58) Field of Classification Search
CPC ..... E02D 3/12; E04G 23/0211
See application file for complete search history.

(56) References Cited

U.S. PATENT DOCUMENTS 6,801,814 B1 10/2004 Wilson et al.
2010/0135731 A1* 6/2010 Barron ..... E02D 3/12 405/263

* cited by examiner

*Primary Examiner* — Tara M. Pinnock
(74) *Attorney, Agent, or Firm* — Rowand LLP

(57) ABSTRACT

Methods and systems for monitoring and controlling a grouting operation are described. In one aspect, the method includes: performing the grouting operation by injecting grout into a borehole and cyclically: monitoring the borehole pressure until the borehole pressure equals a first pressure threshold; in response to determining that the borehole pressure equals the first pressure threshold, halting the injection of grout into the borehole; monitoring the borehole pressure until the borehole pressure decreases to a second pressure threshold, the second pressure threshold being lower than the first pressure threshold; in response to determining that the borehole pressure equals the second pressure threshold, restarting injection of grout into the borehole, until a terminating condition is satisfied and, as a result, terminating the grouting operation.

20 Claims, 3 Drawing Sheets

SYSTEM AND METHOD FOR MONITORING AND CONTROLLING GROUTING OPERATIONS

FIELD

The present disclosure relates to grouting operations and, in particular, to methods and systems for monitoring and controlling grout injection in a borehole.

BACKGROUND

Grout is generally a mixture of water, cement, sand and fine gravel, and is distinguishable from concrete or mortar by its plasticity and fluidity. Grouting is a procedure by which grout is injected into voids, fissures or cavities in soil and rock formations to improve their physical properties, and in particular, to seal fractures, reduce permeability and increase strength of the formations. Grouting can also be used when installing ground anchors and rock bolts in soil and rock to provide structural support.

Most grouting operations require drilling a hole in soil and rock and injecting grout into the hole. The quality of a grouting operation often depends on exercising proper control over levels of grouting volume discharged, grout hole pressure and duration of grouting, with due consideration for time and cost of the operation. Industry practice for quality assessment in grouting operations have focused on a narrow range of tests and traditional methods of data measurement and collection, leaving more to be desired for effective and accurate grouting data collection for analysis.

Therefore, it would be advantageous to provide for improved methods and systems for performing grouting operations.

BRIEF DESCRIPTION OF THE DRAWINGS

Reference will now be made, by way of example, to the accompanying drawings which show example embodiments of the present application, and in which.

Like reference numerals are used in the drawings to denote like elements and features.

DESCRIPTION OF EXAMPLE EMBODIMENTS

In accordance with one aspect, the present application describes a method of monitoring and controlling a grouting operation at a borehole. The method includes: performing the grouting operation by injecting grout into the borehole and cyclically: monitoring the borehole pressure until the borehole pressure equals a first pressure threshold; in response to determining that the borehole pressure equals the first pressure threshold, halting the injection of grout into the borehole; monitoring the borehole pressure until the borehole pressure decreases to a second pressure threshold, the second pressure threshold being lower than the first pressure threshold; in response to determining that the borehole pressure equals the second pressure threshold, restarting injection of grout into the borehole, until a terminating condition is satisfied and, as a result, terminating the grouting operation.

In accordance with another aspect, the present application describes a system for monitoring and controlling a grouting operation. The system includes: a grout pump; a grout pump controller for controlling discharge of grout from the grout pump, the grout pump controller comprising a data storage unit; and a smart grout connector communicably connected to the grout pump controller. The smart grout connector is configured to: perform the grouting operation by injecting grout into the borehole and cyclically: monitoring the borehole pressure until the borehole pressure equals a first pressure threshold; in response to determining that the borehole pressure equals the first pressure threshold, transmit a command to the grout pump controller to halt injection of grout into the borehole; monitor the borehole pressure until the borehole pressure decreases to a second pressure threshold, the second pressure threshold being lower than the first pressure threshold; in response to determining that the borehole pressure equals the second pressure threshold, transmit a command to the grout pump controller to restart injection of grout into the borehole, until a terminating condition is satisfied and, as a result, transmit a command to the grout pump controller to terminate the grouting operation.

Other example embodiments of the present disclosure will be apparent to those of ordinary skill in the art from a review of the following detailed description in conjunction with the drawings.

Example System for Controlling a Grouting Operation

Figure 1:
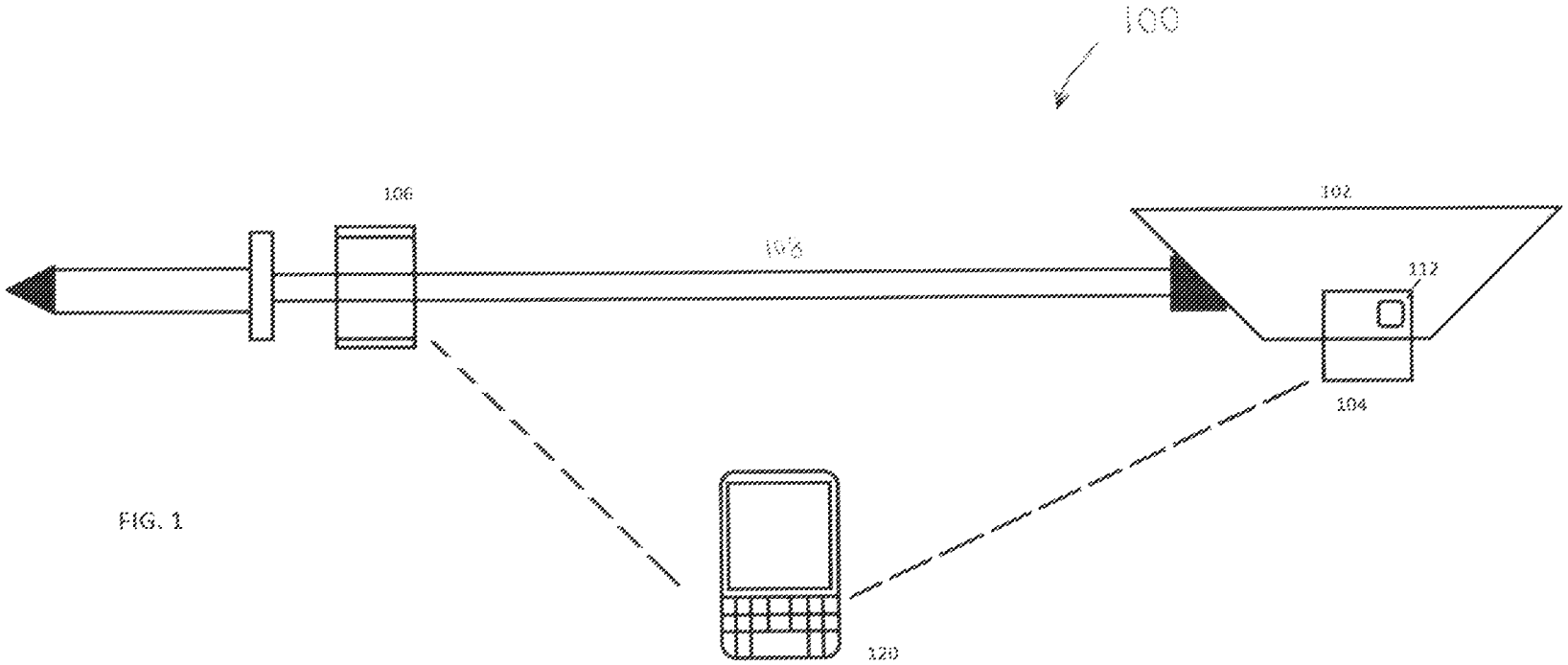
FIG. 1 shows a system for monitoring and controlling a grouting operation, in accordance with example embodiments of the present disclosure.

Reference is now made to FIG. 1, which shows a system 100 for monitoring and controlling a grouting operation. It will be understood that identification of specific types of equipment is not meant to be limiting, only exemplary. The system 100 includes a grout pump 102. The grout pump 102 may be designed to continuously mix and supply high density grout at suitable pressures. In some embodiments, the grout pump 102 may be a positive displacement pump. A positive displacement pump operates by forcing a fixed volume of a fluid from an inlet pressure section of the pump into an outlet section or a discharge pipe. By way of example, a positive displacement piston pump may use cylinders for suction and pressure strokes, drawing grout into and pushing the grout from the piston's tube. In some embodiments, the grout pump 102 may be powered by compressed air or hydraulic power systems driven by an electric motor. In some other embodiments, the grout pump 102 may be manually operated.

In the example of FIG. 1, the grout pump 102 is connected to a grout hose 108, the grout hose 108 being configured to carry discharged grout away from the pump 102. In other embodiments, a grout pipe or one or more connected pipelines may be used to transport discharged grout. The grout pump 102 or the grout hose 108 may include control mechanisms for controlling or varying the flow rate of the grout from the pump 102. In some embodiments, the grout pump 102 may include one or more valves for adjusting the volume of grout that can be discharged from the grout pump 102. For example, the grout pump 102 may have suction and discharge valves which function cooperatively to control the amount of grout discharged. In addition, a ball valve or a swing valve may be used to control the flow of grout within the pump 102. In at least some embodiments, the one or more valves of the grout pump 102 may be mechanically controlled.

As illustrated in FIG. 1, the system 100 also includes a grout pump controller 104. In some embodiments, the grout pump controller 104 may be an on-board control device connected to the grout pump 102. For example, the grout pump controller 104 may comprise a switch box which is physically attached to the grout pump, the switch box including electric switches for turning the grout pump on or off. Alternatively, the grout pump controller 104 may be a digital control panel mounted on the grout pump. The digital control panel may be capable of receiving grouting operation parameters via user input, and may provide digital readings of operation statistics, such as grouting pressure, volume discharged, etc. In some other embodiments, the grout pump controller 104 may be a remote control panel, connected to and in communication with the grout pump 102. The remote control panel may actuate a number of actions on the grout pump, such as starting and stopping a motor of the pump, controlling the rate of grouting.

In some embodiments, the grout pump controller 104 may be a computing device. For example, the grout pump controller 104 may be an integrated computing system adapted for real-time analysis of the grouting operation and control of the grout pump 102. The grout pump controller 104 may include a processor and a storage unit 112, such as memory. In particular, the storage unit 112 may include a searchable database. In at least some embodiments, the grout pump controller 104 can communicate with the grout pump 102 wirelessly, for example, by using WiFi or Bluetooth technology. In other embodiments, the grout pump controller 104 may be connected to the grout pump 102 by one or more data cables.

FIG. 1 shows a smart grout connector 106. In at least some embodiments, the smart grout connector 106 includes a processor, a memory and one or more processor-executable instructions which, when executed by the processor, cause the processor to perform the methods described herein. The smart grout connector 106 may also include one or more sensors for measuring fluid pressure. Alternatively, the smart grout connector 106 may be connected to one or more sensors and is configured to communicate with the one or more sensors, either wirelessly or via physical data cables. The pressure sensors associated with the smart grout connector 106 will be described in more detail below. In some embodiments, the smart grout connector 106 also includes a primary storage unit for storing data relating to the grouting operation. The primary storage unit may be configured to store data collected from sensors and receive grouting operation parameters via user input.

As shown in FIG. 1, the smart grout connector 106 may be connected to the grout pump by a grout hose 108. In some embodiments, the smart grout connector 106 may be connected to an opposite end of the grout hose 108 as the grout pump. That is, the smart grout connector 106 may be connected to the grout hose 108 at a discharging end of the grout hose 108. In other embodiments, the smart grout connector 106 may be positioned at a different point on the grout hose 108. For example, the smart grout connector 106 may be connected to the grout hose 108 at a point which is closer to the grout pump than to the discharging end of the grout hose 108.

In at least some embodiments, the smart grout connector 106 may be configured to communicate with the grout pump controller 104, either wirelessly, using WiFi or Bluetooth, or via one or more data cables.

The system 100 includes a display device 120. In at least some embodiments, the display device 120 is a mobile electronic device. In the example embodiment illustrated in FIG. 1, the display device 120 is a smartphone. The display device 120 may take other forms in other embodiments. For example, in some example embodiments, the display device 120 may be a tablet computer such as a slate computer. In other embodiments, the display device 120 may be a device of another type. For example, the display device 120 may be a multiple-mode communication device configured for both data and voice communication, a television or a computer system. The display device 120 may include a processor and a memory which functions as a data storage unit.

In FIG. 1, the display device 120 is connected to the smart grout connector 106 and the grout pump controller 104. In some embodiments, the display device 120 may be connected wirelessly to the smart grout connector 106 and the grout pump controller 104. For example, these components may be configured to communicate by using WiFi or Bluetooth. In other embodiments, the display device 120, the smart grout connector 106 and the grout pump controller 104 may be connected via one or more data cables.

The display device 120 may include a display in some example embodiments. In some embodiments, the display may be a touchscreen display. The display may be constructed using a touch-sensitive input surface connected to an electronic controller. In at least some embodiments, the display acts as both an input interface and an output interface. The display device 120 can receive user input, store the input information and transmit the input information to both the smart grout connector 106 and the grout pump controller 104. For example, the display device 120 may be used by an operator or a user of the system 100 to input one or more predetermined grouting operation parameters. The one or more predetermined operation parameters may include one or more of: project name; project mileage; rock bolt identifier; capacity borehole pressure; maximum pressure grouting duration; theoretical total grouting volume; and grout pump flow rate. Some of these parameters will be discussed in more detail below. In at least some embodiments, the display device 120 can also receive information transmitted by the smart grout connector 106 and the grout pump controller 104 and present a visual display of the information on the display.

Controlling Grout Injection

Figure 2:
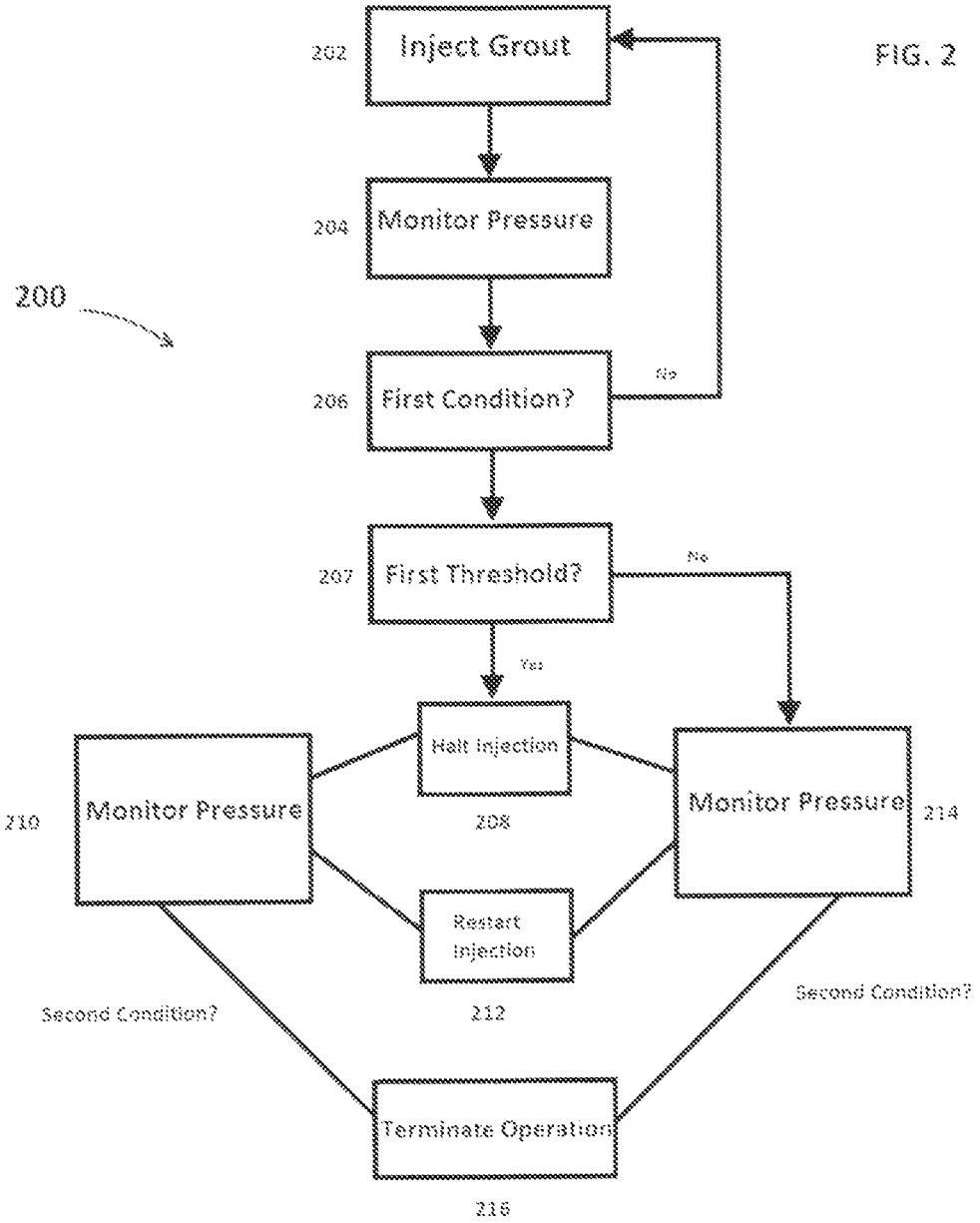
FIG. 2 shows, in flowchart form, an example method for monitoring and controlling grout injection.
Figure 3:
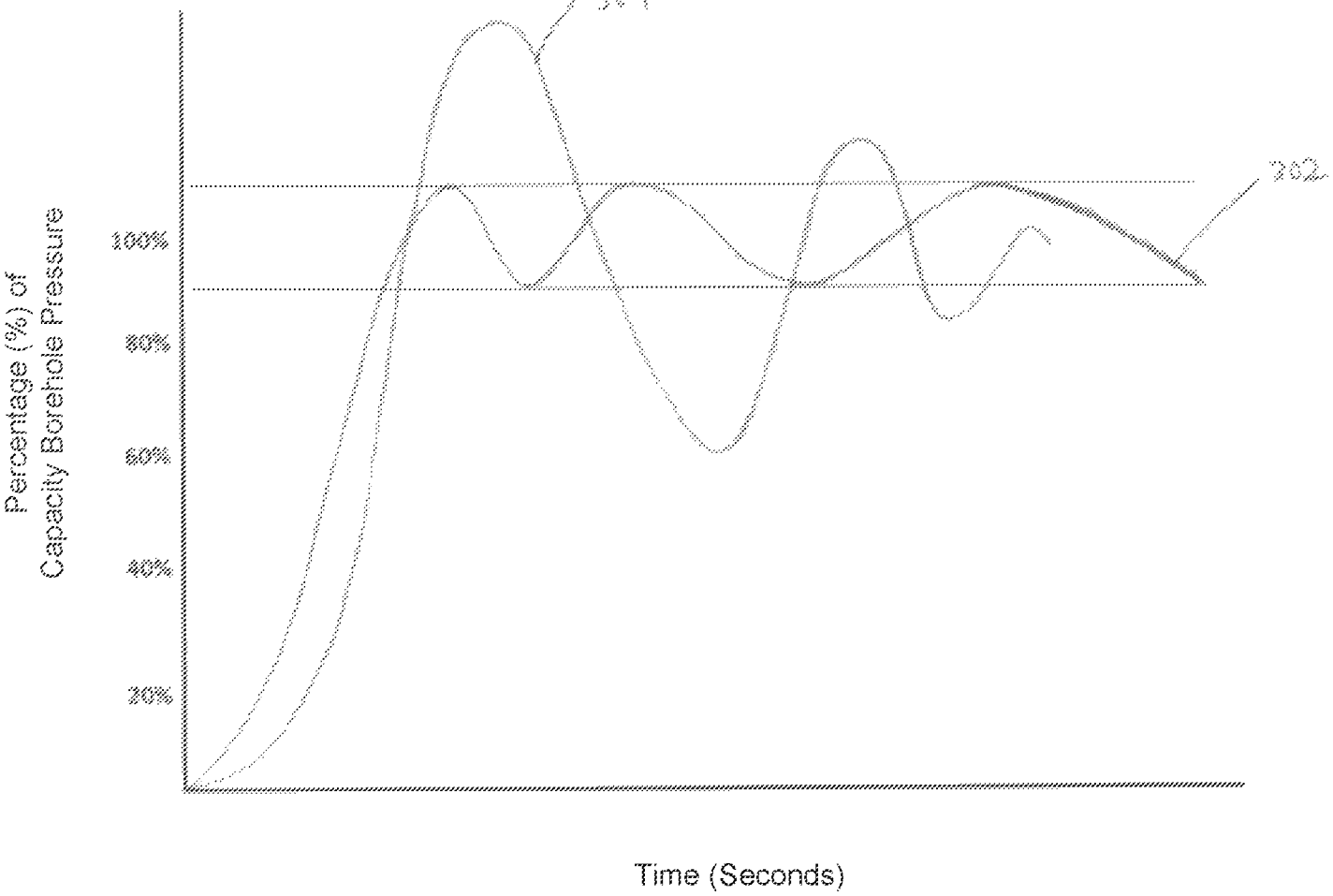
FIG. 3 is a graph of pressure versus time, illustrating variations in measured borehole pressure during a grouting operation performed in accordance with example embodiments of the present disclosure.

Reference is now made to FIG. 2, which shows, in flowchart form, an example method 200 for monitoring and controlling a grouting operation, and FIG. 3, which shows a pressure versus time graph illustrating variations in measured borehole pressure during a grouting operation performed in accordance with one example embodiment of the present disclosure. As described above, the method 200, in this example, may be performed by the smart grout connector 106. In another example, the method 200 may be performed partly by the smart grout connector 106 and partly by the grout pump controller 104.

The method 200 relates to controlling a grout injection operation at a borehole. By way of non-limiting embodiments and examples, the present disclosure will describe embodiments of the method 200 with reference to rock bolts in boreholes. It should be noted, however, that the method 200 may be applicable to grouting operations in a wide range of settings. For example, the method 200 can be used in most cases of pressure grouting that involve injecting grout into generally isolated pore or void space in soil and rock. The method 200 may also be used to correct faults in concrete and masonry structures. Furthermore, in addition to rock bolts, the method 200 can be adapted for grouting, among others, soil nails, micropiles and ground anchors.

A rock bolt may be used to stabilize a rock mass by holding the rock mass together, providing structural support in mining, tunneling and construction operations. Generally, a rock bolt consists of a steel rod with an anchor at one end and a face plate and a nut at the other end. In some embodiments, the rock bolt may be a hollow core bolt. A rock bolt can be inserted in a predrilled borehole in a rock mass or naturally occurring and grouted along its length, by filling the annular space between the bolt and the borehole wall. Such grouting of a rock bolt can counteract the effects of rusting or corrosion and can allow the rock bolt to provide permanent support in rock or soil formations. Grout can be injected into the borehole using a nozzle connected to a grout hose or pipe, the nozzle emitting high pressure streams of grout. Alternatively, an injection tube may be used to guide and feed the grout into the borehole. When anchoring a hollow bolt by grouting, the grout can be injected through the central hole in the bolt to the bottom of the borehole and an injection tube can be used as a breather tube.

As shown in FIG. 2, as grout is injected into the borehole at operation 202, the borehole pressure is monitored and measured at operation 204. Several mechanisms exist for monitoring grouted borehole pressure. In some embodiments, one or more submersible pressure transducers and pressure transmitters may be installed in the borehole. For example, the transducers may be pneumatic or vibrating wire diaphragm piezometers, which can be installed by surrounding them with grout in the borehole. Advantageously, multiple piezometers can be installed together with other instruments in a single borehole. Pressure transducers may also be installed at different points along the depth of the borehole. That is, pressure transducers may be installed at the bottom of the borehole, at the surface, or at one or more points in between the surface and the bottom of the borehole. In other embodiments, borehole pressure can be measured by injecting pressurized air into the borehole and measuring air pressure and flow rate of the compressed air in the borehole. A method of using pressurized air for determining pressure in a borehole at different depths is described in U.S. Pat. No. 7,455,479, which is incorporated herein by reference. Other techniques for measuring pressure and transmitting measured data for collection and assessment may be employed at operation 202.

In some embodiments, borehole pressure measurements may be made periodically. For example, as grout is injected in the borehole, readings from pressure transducers may be relayed to the smart grout connector 106 in predefined regular time intervals. In other embodiments, pressure measurements can be relayed to the smart grout connector 106 continuously throughout the grouting operation. The smart grout connector 106 may also determine a time associated with a borehole pressure measurement value. That is, for a specific borehole pressure level, the smart grout connector 106 may be able to determine an associated time value indicating a time at which the borehole pressure equals the borehole pressure level. Pressure measurement data collected at the smart grout connector 106 may be stored in the primary storage unit of the smart grout connector 106. In at least some embodiments, the primary storage unit will be connected to the rock bolt at the surface of the borehole and be configured to store pressure measurement data specific to the rock bolt.

The efficiency of grouting depends largely on controlling the pressure of the injected grout in the borehole. In particular, correct saturation pressures for the borehole or for sections of the borehole should be determined. If the saturation pressure is too low, the injected grout will not provide sufficient binding for the rock bolt in the borehole and may result in collapse of the borehole for failure to maintain the structural integrity of the borehole. A saturation pressure that is too high may cause tensile failure at the borehole wall, resulting in rock or soil fractures. Therefore, a capacity borehole pressure for the borehole is identified. For example, an operator may determine the capacity borehole pressure and input the capacity borehole pressure as an operation parameter via the display device 120. In some embodiments, the capacity borehole pressure will be higher than the pore fluid pressure of the rock mass but less than the fracture pressure of the borehole. The capacity borehole pressure may be a function of geological conditions of the area of the grouting operation. The capacity borehole pressure may also depend on measured data from previous grouting operations in similar geological sites or from tests conducted to determine fracture formation pressures, such as leak-off and limit tests.

At operation 206, while monitoring the pressure in the borehole, the smart grout connector 106 determines whether a first condition is satisfied at a first time. As grout is injected into the borehole, the height of the grout in the borehole will rise and approach the outer surface of the borehole. Eventually, the volume of grout injected approaches the capacity of the borehole. In at least some embodiments, a theoretical total grouting volume may be calculated prior to the grouting operation, where the theoretical total grouting volume is equal to the difference between a capacity volume of the borehole and the volume of a rock bolt in the borehole. Once the theoretical total grouting volume is determined, an amount of grout equal to the theoretical total grouting volume can be injected into the borehole during the grouting operation. In some embodiments, in order to facilitate making a correct determination of the stopping point, the method 200 uses the concept of a "maximum pressure grouting period". The maximum pressure grouting period is a period of time during the injection operation in which the flow of grout into the borehole is controlled or varied such that the volume of grout injected corresponds substantially to either the capacity of the borehole or a theoretical total grouting volume for the borehole. In other words, the grout flow rate or volume is controlled during the maximum pressure grouting period to ensure that the borehole contains an ideal volume of grout for providing sufficient pressure and structural support while not causing rock or soil fractures. In at least some embodiments, the first condition of operation 206 is a trigger condition for initiating the maximum pressure grouting period for grout injection.

In some embodiments, the first condition is satisfied when the borehole pressure equals a first pressure threshold for the first time. That is, the maximum pressure grouting period may be triggered by the borehole pressure reaching a threshold value. The first pressure threshold may be a fixed level of pressure or a predetermined threshold percentage of the capacity borehole pressure of the borehole. For example, the first condition may be satisfied when the borehole pressure reaches 105% of the capacity borehole pressure for the first time. In some other embodiments, the first condition may be satisfied when a certain amount of time has elapsed since the beginning of the grout injection operation. Specifically, the maximum pressure grouting period may start after a predefined time interval has passed since grout was first injected into the borehole. For example, if it is known that a plurality of boreholes have similar depths and structural characteristics, after acquiring and assessing grouting statistics from one or more of the plurality of boreholes, a fixed time interval for triggering the maximum pressure grouting period can be determined for the remaining boreholes. In yet other embodiments, the first condition can be satisfied when the depth of grout reaches a certain predefined level. For example, the maximum pressure grouting period may be initiated when the height of the grout in the borehole reaches 90% of the borehole depth. In some embodiments, the first condition may be satisfied when a command is received by the smart grout connector 106 to begin the maximum pressure grouting period. For example, an operator or a user of the system may transmit a signal or message to the smart grout connector 106 and receipt of the signal or message by the smart grout connector 106 may satisfy the first condition. The operator may, for example, input a message on the display device 120 to be transmitted to the smart grout connector 106, thereby initiating the maximum pressure grouting period. These are just some of numerous possible conditions for triggering the start of the maximum pressure grouting period. Other conditions, such as those relating to total grout volume, may be used as the first condition at operation 206.

In response to determining that the first condition is satisfied at a first time, the operations 207, 208, 210, 212 and 214 of FIG. 2 are repeated, until a second condition is satisfied at operation 216. Operation 216 and the second condition will be described in more detail below. At operation 207, the smart grout connector 106 determines whether the borehole pressure equals a first pressure threshold. In some embodiments, the first pressure threshold of operation 207 may be equal to the pressure threshold that is used to trigger the maximum pressure grouting period at operation 206. In other embodiments, the first pressure threshold of operation 207 may be a different threshold value. As described above, the pressure threshold may be a fixed level of pressure or a predetermined percentage of the capacity borehole pressure. For example, the first pressure threshold of operation 207 may be 105% of the capacity borehole pressure.

At operation 208, once it has been determined that the borehole pressure equals the first pressure threshold, the injection of grout into the borehole is halted. For example, upon determining that the borehole pressure has reached 105% of capacity borehole pressure, grout injection will be stopped. In at least some embodiments, the smart grout connector 106 will transmit a command to the grout pump controller 104 to stop the pumping of grout from the grout pump. In some other embodiments, the smart grout connector 106 may continuously transmit pressure measurement data to the grout pump controller 104 and the grout pump controller 104 may determine, from the received pressure measurement data, that the grout pumping should be halted when the borehole pressure reaches the first pressure threshold. In other embodiments, the smart grout connector 106 may cause the display device to visually display a signal indicating to an operator or a user that the first pressure threshold has been reached and that grout injection should be halted.

The smart grout connector 106 continues to monitor the borehole pressure, after the halting of grout injection, at operation 210. Halting the injection operation may allow the grout to settle and pack within the borehole and, as a consequence, may permit more grout to be injected after some time. This process of settling and packing may also result in a gradual reduction in borehole pressure. For example, after reaching a peak borehole pressure equal to the first pressure threshold, the borehole pressure may decrease sufficiently to a level indicative that more grout can be injected into the borehole without causing excessive pressure on the walls of the borehole.

When the smart grout connector 106 determines that the borehole pressure has decreased to a second pressure threshold, grout injection can be restarted at operation 212. The second pressure threshold is less than the first pressure threshold and, like the first pressure threshold, can be a fixed level of pressure or a predetermined percentage of the capacity borehole pressure. For example, the second pressure threshold can be 90% of the capacity borehole pressure. The second pressure threshold may be greater than, equal to or less than the capacity borehole pressure. Upon determining that the borehole pressure equals the second pressure threshold, the smart grout connector 106 may transmit a command to the grout pump controller 104 to start the grout pump and discharge grout into the borehole. In some embodiments, the grout pump controller 104 may receive pressure measurement data from the smart grout connector 106 and may itself decide that grout injection should recommence. In other embodiments, the smart grout connector 106 may cause the display device 120 to display a visual cue to an operator or a user that the second pressure threshold has been reached and that more grout should be injected.

At operation 214, the smart grout connector 106 monitors the borehole pressure after grout injection is restarted at operation 212. As more grout is injected in addition to the grout previously injected in the borehole, the borehole pressure will increase accordingly. In response to determining that the borehole pressure equals the first pressure threshold again, the method 200 returns to the operation 207. Therefore, upon satisfying the first condition at operation 206 and thereby triggering the maximum pressure grouting period, method 200 repeats the operations 207, 208, 210, 212 and 214, causing the borehole pressure to vary according to a cycle between the first pressure threshold and the second pressure threshold. Graph 302 of FIG. 3 illustrates the cycle of increasing and decreasing borehole pressure within the range of 90% and 105%. It should be noted that borehole pressure is consistently monitored by the smart grout connector 106 as the borehole pressure fluctuates between the pressure thresholds in the maximum pressure grouting period.

The repeated operations 207, 208, 210, 212 and 214 of FIG. 2 will stop when the smart grout connector 106 determines that a second condition is satisfied at operation 216. That is, the borehole pressure cycle between the first pressure threshold and the second pressure threshold will end upon determining that the second condition has been satisfied. In at least some embodiments, the second condition will be satisfied when a maximum pressure grouting duration elapses since the beginning of the maximum pressure grouting period. Recall that the maximum pressure grouting period commences when the first condition is satisfied at the first time. Thus, the second condition may be satisfied when a predetermined maximum pressure grouting duration has passed since the first condition was satisfied. By way of illustration, reference can be made to some examples of the first condition described above. For example, the second condition may be satisfied when a predetermined maximum pressure grouting duration elapses since: (a) the borehole pressure first reached the first pressure threshold; or (b) a fixed time interval had passed since beginning the grouting operation. In some embodiments, the maximum pressure grouting duration may be a parameter defined prior to the grouting operation. For example, the maximum pressure grouting duration may be input as an operation parameter via the display device 120 and the display device may transmit to at least one of the smart grout connector 106 and the grout pump controller 104 a value of the maximum pressure grouting duration.

Various different conditions may be used as the second condition at operation 216. In some embodiments, if the time taken for borehole pressure to decrease from the first pressure threshold to the second pressure threshold is greater than a predetermined time interval, the second condition will be satisfied. Since the borehole pressure is monitored, at operation 210, after the borehole pressure equals the first pressure threshold, the time elapsed before the borehole pressure falls to the second pressure threshold can be determined. If this elapsed time is greater than a set time interval, the second condition may be satisfied and the repetition of operations 207, 208, 210, 212 and 214 comes to an end. For example, if the borehole pressure takes longer than 10 seconds to decrease from the first pressure threshold to the second pressure threshold, the second condition may be satisfied. When the volume of grout is injected is close to a limit of the borehole, even allowing for the injected grout to settle and pack within the borehole, the borehole pressure may not appreciably decrease or decrease quickly enough. Thus, by selecting an appropriate value for the predetermined time interval, if the time taken for the borehole pressure to fall from the first threshold value to the second threshold value exceeds the predetermined time interval, it may be an indication that the volume of grout injected in the borehole is approaching or at capacity. Similarly, in other embodiments, the time taken for the borehole pressure to increase from the second pressure threshold to the first pressure threshold may be compared to a predetermined time interval. If the time taken for the borehole pressure to increase to the first pressure threshold is less than the predetermined time interval, the second condition is satisfied. Such result of the comparison can indicate that injecting even a small volume of grout causes the borehole pressure to increase appreciably or increase quickly.

In yet other embodiments, the second condition may be satisfied when the borehole pressure equals the first pressure threshold a predefined number of times. That is, if the operations 207, 208, 210, 212 and 214 are repeated until the borehole pressure equals the first pressure threshold a predefined number of times, the repetition of the operations will end. Similarly, the second condition may be satisfied when the borehole pressure equals the second pressure threshold a predefined number of times. In some embodiments, the second condition may be satisfied when a command is received by the smart grout connector 106 to end the maximum pressure grouting period. For example, an operator or a user of the system may transmit a signal or message to the smart grout connector 106 and receipt of the signal or message by the smart grout connector 106 may satisfy the second condition. The operator may, for example, input a message on the display device 120 to be transmitted to the smart grout connector 106, thereby terminating the maximum pressure grouting period.

These are just some of numerous possible conditions for ending the maximum pressure grouting period. Other conditions, such as those relating to total grout volume, may be used as the second condition at operation 206. In at least some embodiments, the second condition may be a combination of the conditions described above. For example, the second condition may be satisfied only when a predetermined maximum pressure grouting duration elapses since the beginning of the maximum pressure grouting period and a time taken for the borehole pressure to fall from the first pressure threshold to the second pressure threshold is greater than a predefined time interval.

In at least some embodiments, the first pressure threshold and the second pressure threshold can be varied or adjusted during the grouting operation. In particular, during the repetition of the operations 207, 208, 210, 212 and 214 in method 200, the values of the first pressure threshold and the second pressure threshold can be changed for one or more of the iterations of the repeated cycle. For example, in a first iteration of the repeated operations, the first pressure threshold can be 140% and the second pressure threshold can be 60%. In a second iteration, the first pressure threshold may be lowered to a different value, say 110%, and the second pressure threshold may be raised to a different value, say 75%. If there is a third iteration, the first pressure threshold and the second pressure threshold may again be adjusted to different values, respectively. In this way, the borehole pressure is controlled to fall within narrower ranges of pressure levels and fluctuations in the borehole pressure can be reduced during the maximum pressure grouting period. Graph 304 of FIG. 3 illustrates this method of narrowing the range of threshold pressure for each iteration of the repeated cycle of increasing and decreasing borehole pressure. One result of such changes in the pressure threshold values is that it may be possible to achieve shorter wait times for the borehole pressure to fall from the first pressure threshold to the second pressure threshold or for the borehole pressure to rise from the second pressure threshold to the first pressure threshold. A further possible result of the changes is that a smaller volume of grout may need to be injected during each subsequent iteration of the repeated cycle to increase the borehole pressure from the second pressure threshold to the first pressure threshold, thereby offering time and cost efficiency during grout injection operations.

In some embodiments, the rate of grout injection may be changed between iterations of the repeated cycle of operations 207, 208, 210, 212 and 214. For example, in a first iteration, the grout flow rate may be set to a first level. That is, when grout injection is restarted at operation 212 after the borehole pressure decreases from the first pressure threshold to the second pressure threshold, the grout flow rate may equal a first value. In a second iteration of the cycle, at operation 212, the grout flow rate may be reduced to a second level, the second level being lower than the first level. This change in grout flow rate between iterations may have the effect of providing more control over speed and volume of grout injection as the borehole capacity volume or pressure is approached. In at least some embodiments, the smart grout connector 106 may signal to the grout pump controller 104 to change the rate of injection. In some other embodiments, the grout pump controller 104 may determine from pressure measurement data received from the smart grout connector 106 and from recognizing a new cycle in the maximum pressure grouting period that the rate of injection should be changed at operation 212.

In at least some embodiments, a third pressure threshold may be used for increased control over volume of grout injection. After grout injection is restarted at operation 212 and borehole pressure begins to increase, grout can be injected until the borehole pressure reaches a third pressure threshold, the third pressure threshold being lower than the first pressure threshold. Upon determining that the borehole pressure equals the third pressure threshold, the rate of grout injection may be changed while continuing to inject more grout into the borehole. For example, grout may be injected at a first flow rate as the borehole pressure increases from the first pressure threshold to the third pressure threshold and at a second flow rate as the borehole increases from the third pressure threshold to the second pressure threshold, the second flow rate being lower than the first flow rate. In some embodiments, a plurality of pressure threshold values between the first pressure threshold and the second pressure threshold may be introduced such that grout injection can be controlled using different rates of injection between two or more pressure intervals. For example, by inserting two pressure thresholds between the first pressure threshold and the second pressure threshold, three pressure intervals will be created, and each of the three pressure intervals can have a different rate of injection.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A method for monitoring and controlling a grouting operation at a borehole, comprising:

performing the grouting operation by injecting grout into the borehole and cyclically performing smart grout operations, the smart grout operations including:

monitoring the borehole pressure until the borehole pressure equals a first pressure threshold, wherein the borehole pressure is a pressure value measured from within the borehole containing the injected grout;

in response to determining that the borehole pressure equals the first pressure threshold, halting the injection of grout into the borehole;

monitoring the borehole pressure until the borehole pressure decreases to a second pressure threshold, the second pressure threshold being lower than the first pressure threshold;

in response to determining that the borehole pressure equals the second pressure threshold, restarting injection of grout into the borehole, until a terminating condition is satisfied and, as a result, terminating the grouting operation.

2. The method of claim 1, wherein cyclically performing smart grout operations is performed in response to determining that a first condition is satisfied at a first time.

3. The method of claim 2, wherein determining that the first condition is satisfied comprises determining that the borehole pressure equals the first pressure threshold at the first time and that the borehole pressure has not equaled the first pressure threshold before the first time.

4. The method of claim 1, wherein at least one of the first pressure threshold and the second pressure threshold is a predetermined threshold percentage of a capacity borehole pressure of the borehole.

5. The method of claim 2, wherein the terminating condition is satisfied when a predetermined maximum pressure grouting duration elapses since the first time.

6. The method of claim 1, further comprising determining, for at least one borehole pressure threshold, an associated time value, the associated time value indicating a time at which the borehole pressure equals the at least one borehole pressure threshold.

7. The method of claim 6, wherein the at least one borehole pressure threshold is a predetermined threshold percentage of a capacity borehole pressure of the borehole.

8. The method of claim 1, wherein the terminating condition is satisfied when a time taken for the borehole pressure to decrease from the first pressure threshold to the second pressure threshold is greater than a predetermined time interval.

9. The method of claim 1, wherein the terminating condition is satisfied when a time taken for the borehole pressure threshold to increase from the second pressure threshold to the first pressure threshold is less than a predetermined time interval.

10. The method of claim 1, further comprising determining a number of times that the borehole pressure equals the first pressure threshold, wherein the terminating condition is satisfied when the determined number of times is equal to a predetermined count.

11. The method of claim 1, further comprising determining a number of times that the borehole pressure equals the second pressure threshold, wherein the terminating condition is satisfied when the determined number of times is equal to a predetermined count.

12. The method of claim 1, wherein the terminating condition is satisfied when a command to terminate the grouting operation is received.

13. The method of claim 1, wherein at least one of the first pressure threshold and the second pressure threshold is changed during the grouting operation.

14. The method of claim 1, wherein restarting injection of grout comprises changing a rate of grout injection.

15. The method of claim 1, wherein monitoring the borehole pressure until the borehole pressure increases to the first pressure threshold comprises:

determining that the borehole pressure equals a third pressure threshold, the third pressure threshold being lower than the first pressure threshold and higher than the second pressure threshold; and in response to determining that the borehole pressure equals the third pressure threshold, changing a rate of grout injection.

16. A system for monitoring and controlling a grouting operation, comprising:

a grout pump;

a grout pump controller for controlling discharge of grout from the grout pump, the grout pump controller comprising a data storage unit; and a smart grout connector communicably connected to the grout pump controller, the smart grout connector configured to:

perform the grouting operation by injecting grout into the borehole and cyclically perform smart grout operations, the smart grout operations include:

monitoring the borehole pressure until the borehole pressure equals a first pressure threshold, wherein the borehole pressure is a pressure value measured from within the borehole containing the injected grout;

in response to determining that the borehole pressure equals the first pressure threshold, transmit a command to the grout pump controller to halt injection of grout into the borehole;

monitor the borehole pressure until the borehole pressure decreases to a second pressure threshold, the second pressure threshold being lower than the first pressure threshold;

in response to determining that the borehole pressure equals the second pressure threshold, transmit a command to the grout pump controller to restart injection of grout into the borehole, until a terminating condition is satisfied and, as a result, transmit a command to the grout pump controller to terminate the grouting operation.

17. The system of claim 16, wherein the smart grout connector is configured to measure borehole pressure and store measured borehole pressure values.

18. The system of claim 16, wherein the smart grout connector is configured to receive one or more predetermined operation input parameters.

19. The system of claim 16, further comprising a display device.

20. The system of claim 19, wherein the smart grout connector, the grout pump controller and the display device are configured to communicate wirelessly or via one or more data cables.

* * * * *